US007028514B2

(12) United States Patent
Banks

(10) Patent No.: US 7,028,514 B2
(45) Date of Patent: Apr. 18, 2006

(54) LOCKING LATCH

(75) Inventor: David C. Banks, Johnson City, TN (US)

(73) Assignee: Hurd Corporation, Greeneville, TN (US)

( * ) Notice: Subject to any disclaimer, the term of this patent is extended or adjusted under 35 U.S.C. 154(b) by 0 days.

(21) Appl. No.: 10/409,481

(22) Filed: Apr. 8, 2003

(65) Prior Publication Data

US 2004/0200247 A1 Oct. 14, 2004

(51) Int. Cl.
*E05B 65/46* (2006.01)

(52) U.S. Cl. ..... 70/86; 70/129; 70/216

(58) Field of Classification Search ..... 70/86, 70/85, 71, 104, 127, 129, 161, 207, 209, 70/215, 216, 224
See application file for complete search history.

(56) References Cited

U.S. PATENT DOCUMENTS 2,257,741 A * 10/1941 Gray ..... 70/85
2,697,342 A * 12/1954 McConnell et al. ..... 70/216
3,019,632 A * 2/1962 Russell ..... 70/224
3,455,126 A * 7/1969 Spon et al. ..... 70/216
3,681,954 A * 8/1972 Hawkins ..... 70/216
4,609,233 A * 9/1986 Walla ..... 312/219
5,551,263 A * 9/1996 Myers et al. ..... 70/86
5,797,286 A * 8/1998 Armstrong ..... 70/224
6,122,946 A 9/2000 Blanch
6,247,342 B1 6/2001 Lilas
6,351,976 B1 * 3/2002 Chen ..... 70/224

* cited by examiner

*Primary Examiner*—John B. Walsh
(74) *Attorney, Agent, or Firm*—Luedeka, Neely & Graham, P.C.

(57) ABSTRACT

A locking latch includes an outer housing and a handle in relative movable engagement with the outer housing. In rigid engagement with the handle is a barrel positioned in the outer housing. A key cylinder is in relative movable engagement with the barrel. The key cylinder is rotatable by a key between locked and unlocked positions in which rotation of the handle is, respectively, inhibited and enabled. A latching member is in movable engagement with the barrel so that rotation of the barrel by the handle induces movement of the latching member to latch and unlatch an access structure of a container. An engaging member is in movable engagement with the key cylinder so that rotation of the key cylinder induces movement of the engaging member between an engaged position where the handle is locked to the outer housing to inhibit rotation of the handle and an unengaged position where rotation of the handle is not inhibited.

15 Claims, 3 Drawing Sheets

LOCKING LATCH

FIELD OF THE INVENTION

The present invention relates generally to locking devices. More particularly, the present invention relates to a keyed locking latch where the latch can be operated in an unlocked condition without the key positioned in the locking mechanism.

BACKGROUND OF THE INVENTION

A variety of latching devices are available for latching doors, drawers, and similar container access structures. Such latch assemblies typically include a knob or some form of handle that is rotated to move the latching member between its latched and unlatched positions. Latch assemblies often include a key operated lock that enables the latch to be locked in either the latched or unlatched position. Unfortunately, such locking latches typically require use of the key in order to move the latch between its latched and unlatched positions. For containers that require frequent access, use of the key in order to access the container contents becomes time consuming and exhausting. To ease these difficulties, operators tend to either leave the latch in its unlatched position or leave the key in the latch. Each of these solutions, however, significantly reduces the security of the container contents.

What is needed, therefore, is a locking latch that eliminates one or more disadvantages of prior locking latch assemblies.

SUMMARY OF THE INVENTION

The present invention achieves it objectives by providing a latching apparatus for latching an access structure of a container. The apparatus includes a rotatable handle and an outer housing in relative movable engagement with the handle such that the handle is rotatable relative to the outer housing. A barrel positioned in the outer housing is in movable engagement with the handle such that rotation of the handle induces rotation of the barrel. A key cylinder is in relative movable engagement with the barrel such that the key cylinder is rotatable relative to the barrel. The key cylinder is rotatable by a key relative to the handle between a locked position in which rotation of the handle is inhibited and an unlocked position in which rotation of the handle is enabled. A latching member is in movable engagement with the barrel such that rotation of the barrel induces movement of the latching member to latch and unlatch the access structure. The latching member is in relative movable engagement with the outer housing such that the latching member is movable relative to the outer housing. An engaging member is in movable engagement with the key cylinder such that rotation of the key cylinder induces movement of the engaging member between an engaged position corresponding to the locked position of the key cylinder where the engaging member couples the barrel to the outer housing to inhibit rotation of the handle relative to the outer housing and an unengaged position corresponding to the unlocked position of the key cylinder where the engaging member does not inhibit rotation of the handle relative to the outer housing.

Depending on the particular installation, the latching member may be configured to directly latch the access structure. Alternatively, the latching member may be configured to activate additional linkage members which latch and unlatch the access structure.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
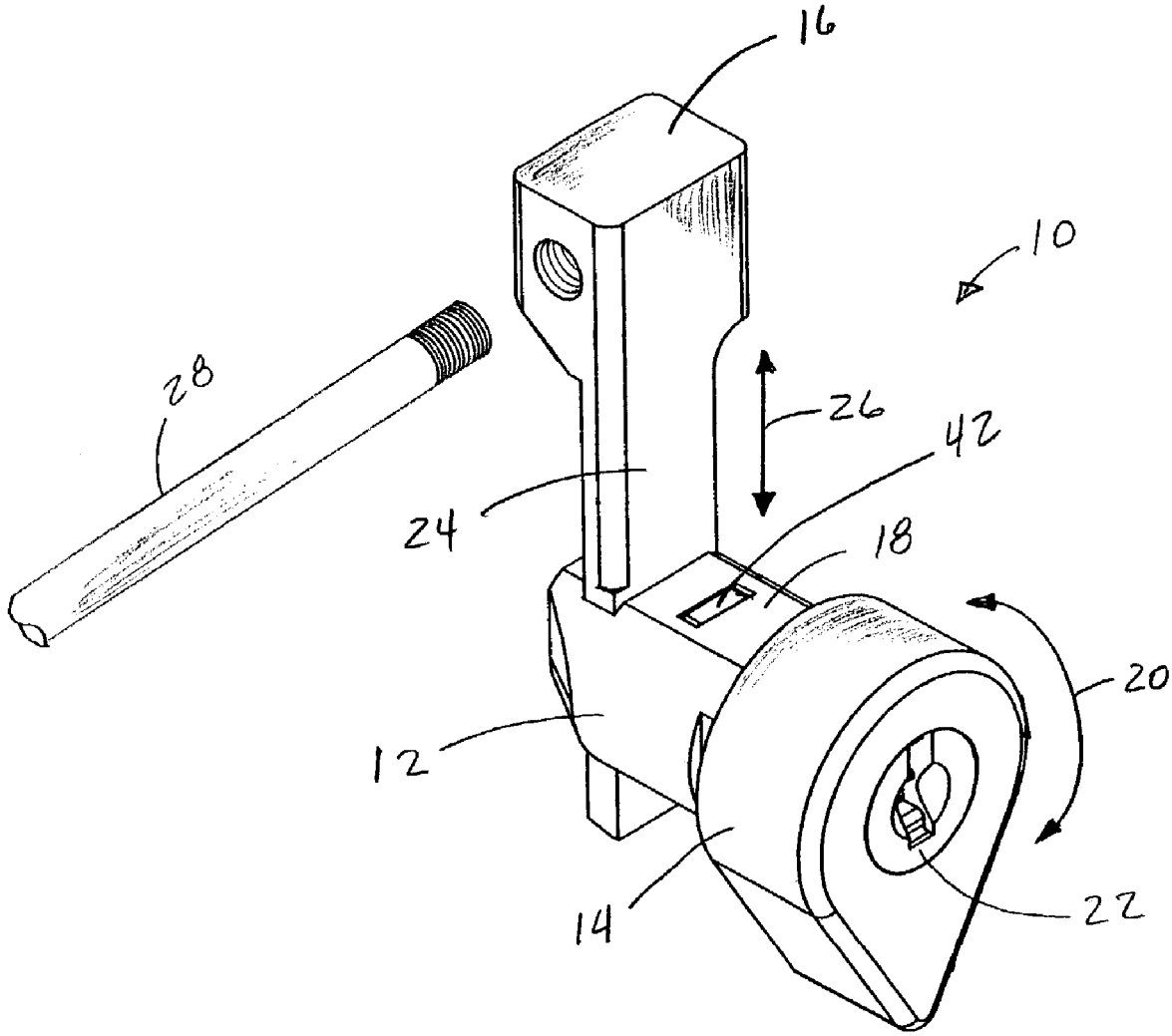
FIG. 1 is a perspective view of a locking latch according to the invention.
Figure 2:
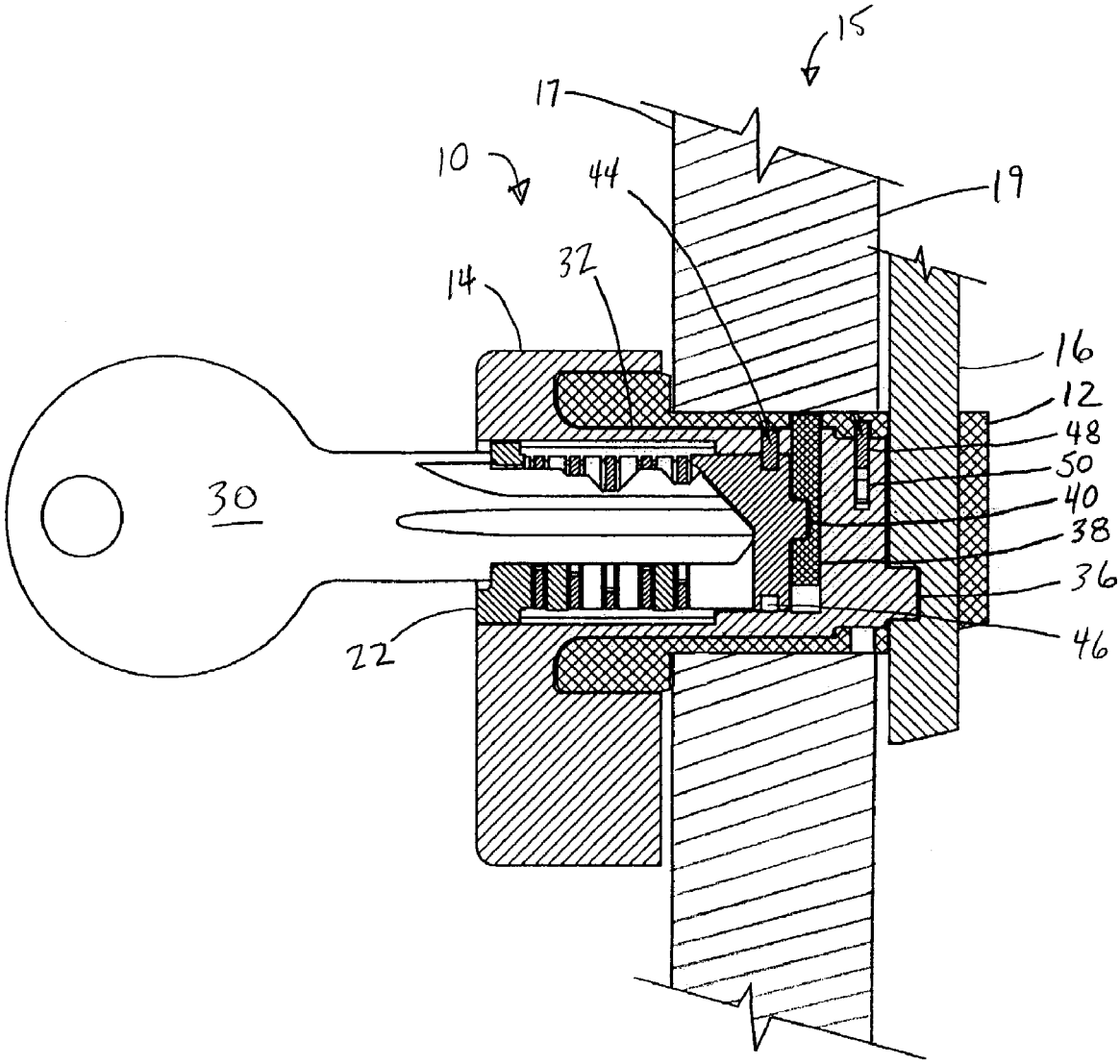
FIG. 2 is a first cross-sectional view of the locking latch of FIG. 1.

FIGS. 1 and 2 illustrate a locking latch 10 for locking and latching one or more access structures (such as a drawer) of a container (such as a cabinet.) The latch 10 includes an outer housing 12, a handle 14, and a latching member 16. The geometry of the outer housing 12 is such that it does not rotate when affixed to the container. In a preferred embodiment, the housing 12 includes non-circular features, such as one or more flats 18, which function to properly orient the latch 10 when affixed to the container and to inhibit rotation of the outer housing 12. The outer housing 12 preferably provides a protective enclosure for elements positioned internal to the housing 12, although the housing 12 need not completely enclose the internal elements.

FIG. 2 shows the latch 10 affixed to the wall 15 of a container. Wall 15 may be the wall of an access structure, such as a drawer, for accessing the container, or wall 15 may be a stationary wall of the container that does not form a part of an access structure. Since the handle 14 must be accessible by a user of the container, the handle 14 is positioned adjacent an external surface 17 of the container and the latching member 16 is positioned adjacent an internal surface 19 of the container where the latching member 16 cannot be accessed by unauthorized users.

In a preferred embodiment, the handle 14 is teardrop-shaped and in relative movable engagement with the outer housing 12 such that the handle 14 is rotatable relative to the outer housing 12. In other words, the handle 14 can be rotated (as indicated by direction arrow 20) relative to housing 12 to latch and unlatch the container's access structure(s). The handle 14 can be locked by use of a key 30 inserted into a key cylinder 22 having tumbler plates which operate in conventional fashion.

The latching member 16 may be any structural member suitable for latching and unlatching an access structure. In a preferred embodiment, the latching member 16 includes a rail portion 24 which moves substantially linearly up and down adjacent the distal end of the outer housing 12 as indicated by direction arrow 26. An upper portion of the latching member 16 is configured to receive one or more linkage members 28, such as by threaded engagement. The linkage members 28 are in movable engagement with the latching member 16 such that movement of the latching member 16 induces movement of the linkage members 28 to latch and unlatch the access structure. The need for linkage members 28, as well as their configuration, will of course depend on the particular installation. For some installations, the latching member 16 is configured to directly latch the access structure without the need for additional linkage members 28.

With reference to FIG. 2, the latch 10 includes a barrel 32 positioned in the outer housing 12 in movable engagement with the handle 14 such that rotation of the handle 14 induces rotation of the barrel 32. The barrel 32 is preferably in rigid engagement with the handle 14. In a preferred embodiment, this is accomplished by fabricating the barrel 32 and handle 14 as a single part. Alternatively, the barrel 32 and handle 14 are separate parts rigidly connected to one another, such as by welding or adhesive.

The barrel 32 includes at its distal end a barrel stud 36 which projects outwardly from the barrel's distal end as shown in FIG. 2. The barrel stud 36 is received by a slot formed in the latching member 16. The barrel stud 36 is positioned off-center from the central axis of the barrel 32 so that when the barrel 32 is rotated by the handle 14, the barrel stud 36 moves the latching member 16 linearly as shown by direction arrow 26 of FIG. 1.

Figure 3:
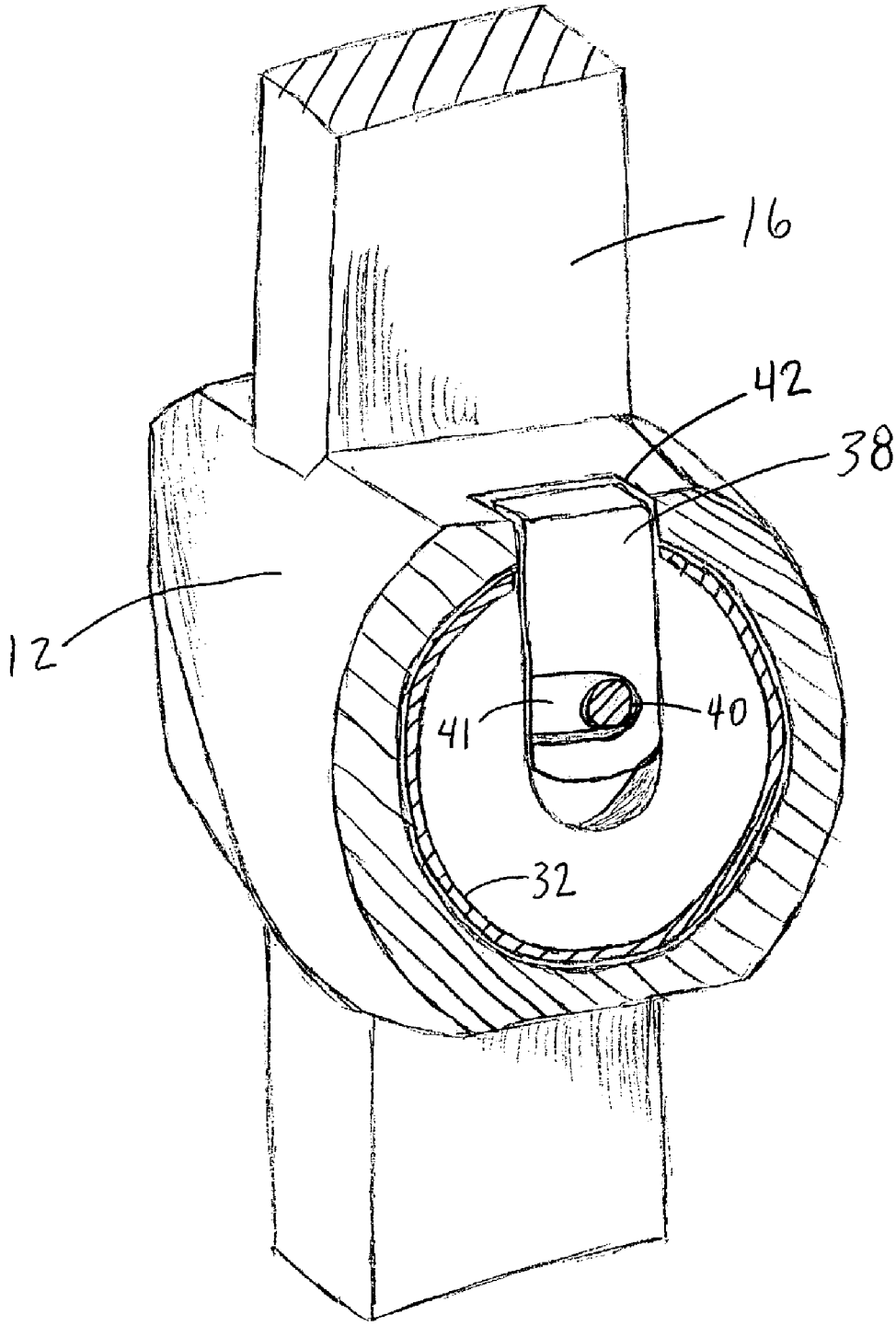
FIG. 3 is a second cross-sectional view of the locking latch of FIG. 1 showing details of the engaging member.

When the key cylinder 22 is in its locked position, the handle 14 is locked and cannot be rotated. Thus, in order to turn the handle 14 to move the latching member 16 between its latched and unlatched positions, the key cylinder 22 must be in the unlocked positioned. In a preferred embodiment, an engaging member 38 in movable engagement with the key cylinder 22 is employed to operate in conjunction with the key cylinder 22 to lock and unlock the handle 14. Rotation of the key cylinder 22 by key 30 induces substantially linear movement of the engaging member 38 between an engaged position corresponding to the locked position of the key cylinder 22 and an unengaged position corresponding to the unlocked position of the key cylinder 22. In a preferred embodiment, this is accomplished by providing a cylinder stud 40 at the distal end of the key cylinder 22. The cylinder stud 40 projects outwardly from the key cylinder's distal end and is slidably received by a slot 41 (FIG. 3) formed in the engaging member 38. As illustrated in FIGS. 2 and 3, slot 41 has a width slightly greater than the diameter of the cylinder stud 40 whereby the cylinder stud 40 is substantially in constant engagement with a surface of the slot that moves the engaging member 38. The cylinder stud 40 is positioned off-center from the central axis of the key cylinder 22 so that when the key cylinder 22 is rotated by the key 30, the cylinder stud 40 moves the engaging member 38 linearly between its engaged position where the engaging member 38 couples the barrel 32 to the outer housing 12 to inhibit rotation of the handle relative to the outer housing 12 and its unengaged position where the engaging member 38 does not inhibit rotation of the handle 14 relative to the outer housing 12.

FIG. 2 shows the engaging member 38 in the engaged position and the key cylinder 22 in the locked position. As can be seen in FIGS. 1 and 3, the upper portion of the engaging member 38 extends beyond an opening formed in the barrel 32 into an opening 42 (or, alternatively, a notch or detent) formed in the outer housing 12. In this position, the engaging member 38 couples the barrel 32 and outer housing 12 to inhibit rotation of the barrel 32 and handle 14. From the locked position shown in FIG. 2, the key cylinder 22 can be rotated by the key 30 to move the upper portion of the engaging member 38 downwardly at or below the barrel 32 so as to decouple the barrel 32 from the outer housing 12 to thereby unlock the latch 10. In the unlocked position, the key 30 can be removed from the key cylinder 22 and the handle 14 can be freely rotated to latch and unlatch an access structure of the container. Thus, unlike prior art latches, the latch 10 described herein enables a user to unlock the latch 10, remove the key 30 from the key cylinder 22, and rotate the handle 14 to latch and unlatch the access structure. Such key-free operation of the latch 10 is particularly advantageous in applications that require frequent access to the container, which is typical for package delivery workers whose packages are kept in a container on their delivery vehicle.

With continued reference to FIG. 2, a key cylinder retaining member 44 is employed to retain the key cylinder 22 in relative movable engagement with the barrel 32. In a preferred embodiment, the key cylinder retaining member 44 is a retaining element (such as a pin or disc) positioned in the barrel 32 as shown and extending downwardly into a groove 46 formed adjacent the distal end of the key cylinder 22 so that as the key cylinder 22 is rotated, retaining element 44 stays extended into the groove 46 and prevents separation of key cylinder 22 from the barrel 32.

A handle retaining member 48 is likewise employed to retain the handle in relative movable engagement with the outer housing 12. In a preferred embodiment, the handle retaining member 48 is a retaining element (such as a pin or disc) positioned in the outer housing 12 as shown and extending downwardly into a groove 50 formed adjacent the distal end of the barrel 32 so that as the handle 14 and barrel 32 are rotated in unison, retaining element 48 stays extended into the groove 50 and prevents separation of the barrel 32 from the outer housing 12.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. A latching apparatus for latching an access structure of a container, said apparatus comprising:

a rotatable handle;

an outer housing in relative movable engagement with said handle such that the handle is rotatable relative to the outer housing;

a barrel positioned in said outer housing in movable engagement with said handle such that rotation of the handle induces rotation of the barrel;

a key cylinder in relative movable engagement with said barrel such that the key cylinder is rotatable relative to the barrel, said key cylinder being rotatable by a key relative to the handle between a locked position in which rotation of the handle is inhibited and an unlocked positioned in which rotation of the handle is enabled;

a latching member in movable engagement with said barrel such that rotation of the barrel induces movement of the latching member to latch and unlatch the access structure, said latching member being in relative movable engagement with said outer housing such that the latching member is movable relative to the outer housing;

an engaging member in movable engagement with said key cylinder such that rotation of the key cylinder induces movement of the engaging member between an engaged position corresponding to the locked position of the key cylinder wherein the engaging member couples the barrel to the outer housing to inhibit rotation of the handle relative to the outer housing and an unengaged position corresponding to the unlocked position of the key cylinder wherein the engaging member does not inhibit rotation of the handle relative to the outer housing; and a stud and slot mechanism disposed between the engaging member and the key cylinder and providing the movable engagement, the mechanism having a stud slidably received within a slot, with the slot having a width greater than the diameter of the stud whereby the stud is substantially in constant engagement with a surface of the slot that moves the engaging member between the engaged and unengaged positions.

2. The latching apparatus of claim 1 wherein movement of said latching member is substantially linear.

3. The latching apparatus of claim 1 wherein movement of said engaging member is substantially linear.

4. The latching apparatus of claim 1, further comprising a key cylinder retaining member for retaining the key cylinder in relative movable engagement with said barrel.

5. The latching apparatus of claim 1, further comprising a handle retaining member for retaining the handle in relative movable engagement with the outer housing.

6. The latching apparatus of claim 1 wherein said handle is positioned adjacent an external surface of the container and said latching member is positioned adjacent an internal surface of the container.

7. The latching apparatus of claim 1, further comprising one or more linkage members in movable engagement with said latching member such that movement of the latching member induces movement of the one or more linkage members to latch and unlatch the access structure.

8. A latching apparatus for latching an access structure of a container, said apparatus comprising:

a rotatable handle;

an outer housing having a first end adjacent an external surface of the container and in relative movable engagement with said handle such that the handle is rotatable relative to the first end of the outer housing, said outer housing including a second end adjacent an internal surface of the container and in opposed relation to the first end;

a barrel positioned in said outer housing in rigid engagement with said handle such that rotation of the handle induces rotation of the barrel;

a key cylinder in relative movable engagement with said barrel such that the key cylinder is rotatable relative to the barrel, said key cylinder having a first end configured to receive a key and a second end in opposed relation to the first end, said key cylinder being rotatable by said key relative to the handle between a locked position in which rotation of the handle is inhibited and an unlocked positioned in which rotation of the handle is enabled;

a latching member in movable engagement with the second end of said barrel such that rotation of the barrel induces linear movement of the latching member to latch and unlatch the access structure, said latching member being in relative movable engagement with said outer housing such that the latching member is movable relative to the outer housing;

an engaging member in movable engagement with the second end of said key cylinder such that rotation of the key cylinder induces linear movement of the engaging member between an engaged position corresponding to the locked position of the key cylinder wherein the engaging member couples the barrel to the outer housing to inhibit movement of the handle and an unengaged position corresponding to the unlocked position of the key cylinder wherein the engaging member does not inhibit movement of the handle; and a stud and slot mechanism disposed between the engaging member and the key cylinder and providing the movable engagement, the mechanism having a stud slidably received within a slot, with the slot having a width greater than the diameter of the stud whereby the stud is substantially in constant engagement with a surface of the slot that moves the engaging member between the engaged and unengaged positions.

9. The latching apparatus of claim 8, further comprising a key cylinder retaining member for retaining the key cylinder in relative movable engagement with said barrel.

10. The latching apparatus of claim 8, further comprising a handle retaining member for retaining the handle in relative movable engagement with the outer housing.

11. The latching apparatus of claim 8 wherein said handle is positioned adjacent said external surface of the container and said latching member is positioned adjacent said internal surface of the container.

12. The latching apparatus of claim 8, further comprising one or more linkage members in movable engagement with said latching member such that movement of the latching member induces movement of the one or more linkage members to latch and unlatch the access structure.

13. A latching apparatus for latching an access structure of a container, said apparatus comprising:

a rotatable handle;

an outer housing having a first end adjacent an external surface of the container and in relative movable engagement with said handle such that the handle is rotatable relative to the first end of the outer housing, said outer housing including a second end adjacent an internal surface of the container and in opposed relation to the first end;

a handle retaining member for retaining the handle in relative movable engagement with the outer housing;

a barrel positioned in said outer housing in rigid engagement with said handle such that rotation of the handle induces rotation of the barrel;

a key cylinder in relative movable engagement with said barrel such that the key cylinder is rotatable relative to the barrel, said key cylinder having a first end configured to receive a key and a second end in opposed relation to the first end, said key cylinder being rotatable by said key relative to the handle between a locked position in which rotation of the handle is inhibited and an unlocked positioned in which rotation of the handle is enabled;

a key cylinder retaining member for retaining the key cylinder in relative movable engagement with said barrel;

a latching member in movable engagement with the second end of said barrel such that rotation of the barrel induces linear movement of the latching member to latch and unlatch the access structure, said latching member being in relative movable engagement with said outer housing such that the latching member is movable relative to the outer housing;

an engaging member in movable engagement with the second end of said key cylinder such that rotation of the key cylinder induces linear movement of the engaging member between an engaged position corresponding to the locked position of the key cylinder wherein the engaging member couples the barrel to the outer housing to inhibit movement of the handle and an unengaged position corresponding to the unlocked position of the key cylinder wherein the engaging member does not inhibit movement of the handle; and a stud and slot mechanism disposed between the engaging member and the key cylinder and providing the movable engagement, the mechanism having a stud slidably received within a slot, with the slot having a width greater than the diameter of the stud whereby the stud is substantially in constant engagement with a surface of the slot that moves the engaging member between the engaged and unengaged positions.

14. The latching apparatus of claim 13 wherein said handle is positioned adjacent said external surface of the container and said latching member is positioned adjacent said internal surface of the container.

15. The latching apparatus of claim 13, further comprising one or more linkage members in movable engagement with said latching member such that movement of the latching member induces movement of the one or more linkage members to latch and unlatch the access structure.

* * * * *